United States Patent [19]

Strolenberg

[11] 4,051,568

[45] Oct. 4, 1977

[54] LIFE SAVING GARMENT

[76] Inventor: Willem Josef George Strolenberg, 11, Bartholomew Lane, Sudbury, Suffolk, England

[21] Appl. No.: 707,406

[22] Filed: July 21, 1976

[30] Foreign Application Priority Data

July 23, 1975 United Kingdom ..... 30802/75

[51] Int. Cl.[2] ..... B63C 9/12

[52] U.S. Cl. ..... 9/340; 9/332; 9/341; 9/345

[58] Field of Search ..... 9/337-342, 9/345, 329, 330, 331, 11 A, 333; 2/81

[56] References Cited

U.S. PATENT DOCUMENTS

| | | | |
|---|---|---|---|
| 1,419,272 | 6/1922 | Kolberg | 9/342 |
| 2,905,954 | 9/1959 | Lanciano, Jr. | 9/345 X |
| 3,050,752 | 8/1962 | Birchall | 9/345 X |
| 3,155,992 | 11/1964 | Shewmake et al. | 9/11 A |
| 3,199,128 | 8/1965 | Nöjd | 9/341 X |
| 3,266,069 | 8/1966 | O'Link | 9/341 |
| 3,744,534 | 7/1973 | Henry | 2/81 X |
| 3,750,205 | 8/1973 | Pfeifer | 9/345 |
| 3,805,308 | 4/1974 | Hirsch | 9/340 |

*Primary Examiner*—Stephen G. Kunin
*Assistant Examiner*—Sherman D. Basinger
*Attorney, Agent, or Firm*—J. Rodman Steele, Jr.

[57] ABSTRACT

Life saving garment including an air-filled liner for independent use or for attachment to the jacket of a working suit. The liner has front, rear and expandible collar sections including chest, back and shoulder air compartments. The air mainly occupies the back compartment under normal working conditions and is forced into the upper parts of the sections by water pressure. The expanded shoulder compartments and a buoyant neck ring keep the wearer's head above water.

9 Claims, 6 Drawing Figures

LIFE SAVING GARMENT

This invention relates to a life saving garment.

People working at sea, for example, crew on drilling rigs or supply vessels and construction workers on marine structures, are in danger of falling into the sea, or of abandoning ship or station. Most known life jackets are inflated by bottled gas or by mouth via a tube, or they contain a buoyant substance such as cork or foam. Bulky life jackets are not liked by the people who have to wear them because movement is restricted when working. Consequently, such life jackets are not worn when they should be for safety. Moreover, inflatable jackets have the disadvantage that the wearer does not know that the jacket is in perfect order until it is used, when it is inflated. The wearer may also be so injured, or unconscious, that he cannot inflate the jacket.

One of the objects of the present invention is to enable the manufacture of a life saving garment which is comfortable to wear and does not restrict movement under working conditions.

Another object of the invention is to provide a life saving garment which will cause the wearers head to be maintained above water, even if the wearer is unconscious.

According to the invention, a life saving garment comprises a double-skinned flexible liner, which liner encloses a predetermined quantity of air and has at least a back portion, a front portion and a collar portion, the quantity of air in the liner mainly occupying the back portion during normal working conditions to enable freedom of movement, said liner and said quantity of air being such that the air is forced into the upper part of said back and front portions and into said collar portion when the wearer is substantially submerged in water, whereby buoyancy is provided for maintaining the wearers head above the water.

Preferably, said collar portion is expansible by said air when the wearer is submerged in water. To provide additional buoyancy at the head end of the garment, the liner is preferably provided in combination with a buoyant neck ring. The liner and the neck ring may be secured to the inside of a jacket so that both the liner and the neck ring are correctly positioned on the wearers torso when the jacket is worn. It is also preferred to provide additional air compartments on said front portion of said liner, said compartments communicating with said front portion by means of restrictors whereby the air can communicate between said compartments and said front portions during normal working conditions, but is trapped in said compartments when the wearer is substantially submerged in water. The additional compartments may be attached to the front portion in the manner of lapels which lay flat on said front portion during normal working conditions and which stand up from said front portion when inflated by said trapped air.

Figure 1:
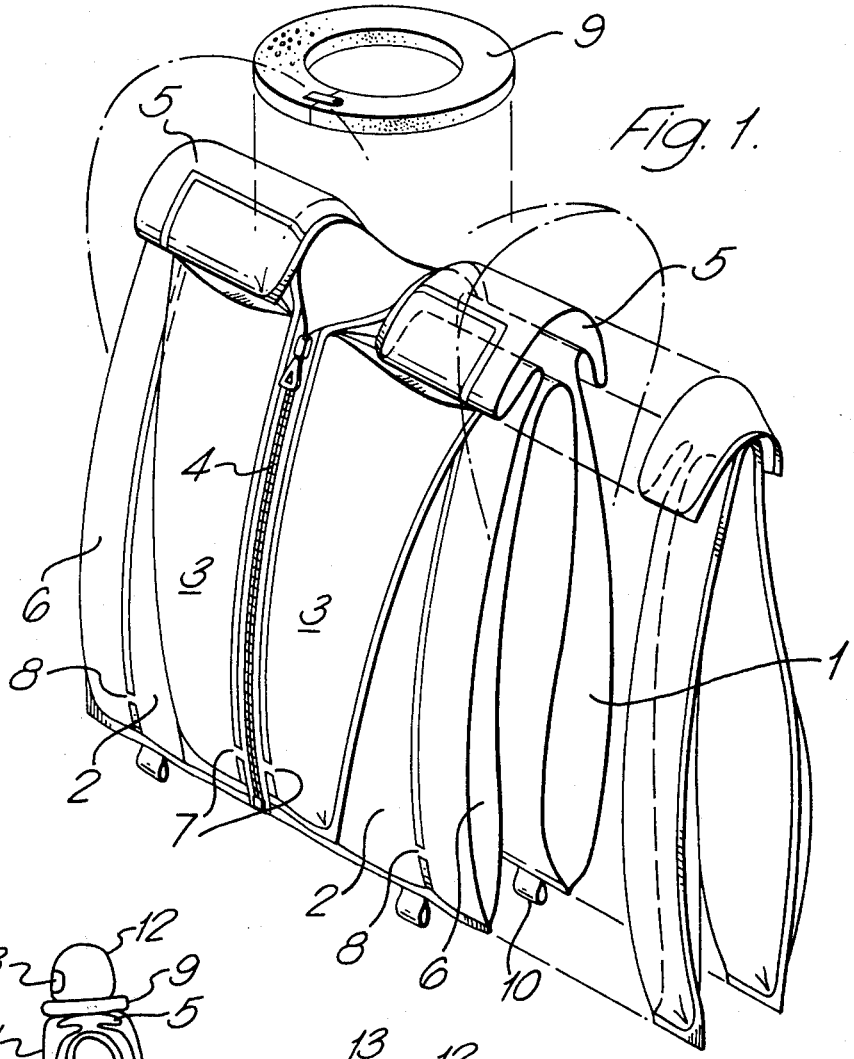
Figure 2:
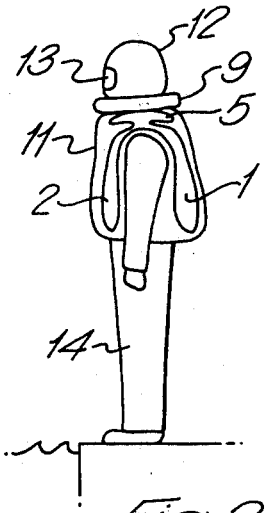
Figure 3:
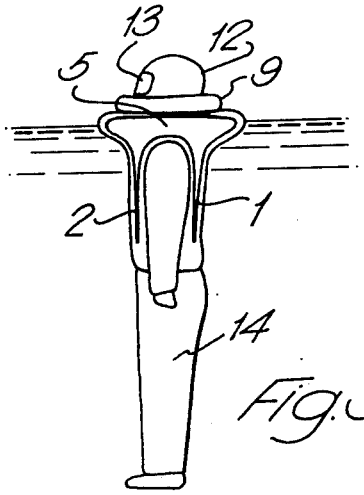
Figure 4:
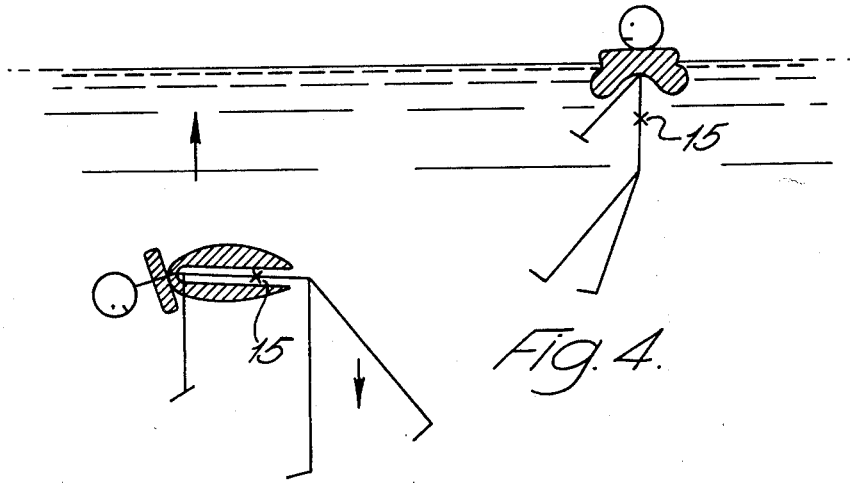
Figure 5:
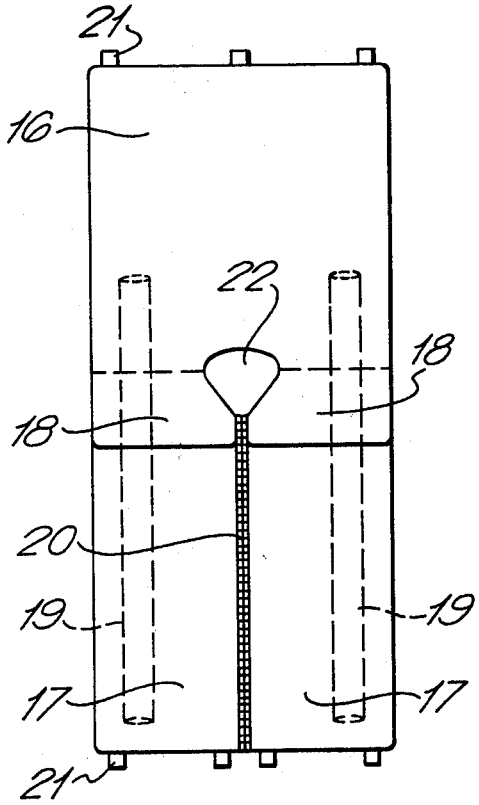
Figure 6:
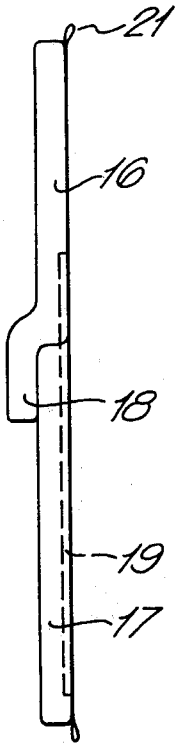

An embodiment of the invention will now be described with reference to the accompanying drawings, in which:

FIG. 1 is a perspective view of a liner according to the invention for use as a life saving garment, FIG. 2 is a partly sectioned view of the life saving garment when worn under normal working conditions, FIG. 3 is a partly sectioned view of the garment when the wearer is substantially submerged in water, FIG. 4 schematically illustrates how the wearer floats with his head upright after being submerged, and FIGS. 5 and 6 are plan and elevational views of a modified liner of more simple construction.

Referring to the drawings, FIG. 1 illustrates a liner for a life saving garment, which liner is of double-walled construction. The liner includes a rear air compartment 1 in a back portion, two front air compartments 2, two lapel-shaped air compartments 3 in a front or chest portion and two shoulder air compartments 5 in a collar portion. The front compartments 2 are joined to the respective lapel compartments 3 along an inner vertical edge which lies adjacent a fastener such as a zip 4. The upper, outer and lower edges of compartments 3 are free of the front or chest portion of the liner. The rear compartment 1 joins the shoulder air compartments 5, which are expansible (in the manner of gussets) and which normally lay flat on the shoulders of the wearer. The lapel-shaped compartments 3 also normally lay substantially flat against the wearers chest. However, when the wearer falls into the water, the shoulder compartments 5 expand upwardly from the shoulders and the lapel-shaped compartments 3 stand out from the wearers chest, as will be explained below.

The rear compartment 1 communicates freely with each of the shoulder compartments 5. The shoulder compartments 5 communicate freely with column-shaped compartments 6 at each side of the front compartments 2. Compartments 6 communicate through restrictors 8 with the front compartments 2 and the front compartments communicate through restrictors 7 with the lapel-shaped compartments 3. The purpose of restrictors 7, 8 is to enable air to pass at a restricted rate, between the front compartments 2 and lapel compartments 3 to the shoulder compartments 5 and rear compartment 1 when the wearer moves under normal working conditions. This allows a reasonably free circulation of air so that the wearers movements are not restricted whilst he is working. However the air cannot pass rapidly between compartments 1, 5 and 2, 3 if the liner is suddenly compressed, when the wearer falls into the water and the water pressure acts on the air trapped in the air compartments of the liner. When the wearer is submerged, the liner will assist in bringing him to an upright position, as explained below, whereby the air moves into the upper sections of the rear and front compartmentsl, 2, 3 and into the shoulder compartments 5. The restrictors 7, 8 thereby assist in trapping the air in the upper sections of the liner as shown in FIG. 3. When the upper sections are so inflated, as shown in FIG. 3, they assist in keeping the wearers head clear of the water.

To ensure that the wearers head is completely lifted out of the water and maintained in this position, whether or not the wearer is unconscious, a buoyant neck ring 9 is attached to the wearers neck. Whilst the liner and the neck ring may be worn as shown in FIG. 1, especially in tropical conditions, the liner and neck ring are preferably attached to a loose fitting jacket (FIGS. 2 and 3), so that they are worn in the correct positions when the wearer puts on the jacket. The neck ring 9 may be made of foam with captive air bubbles so that there is no need to secure it in an airtight or watertight manner to the liner or jacket. For example, the neck ring 9 may be located in an annular collar which is fixed to the jacket, the outer circumferential edge of the collar including a zip to provide access to the neck ring 9.

The liner may be made from flexible, airtight material such as plastics or rubber. It may be fitted with belt or tie loops 10 for attachment either to a belt (tropical use) or to draw string in the waist of the jacket.

A predetermined quantity of air is sealed into the liner so as to provide a buoyancy of at least 42 lbs. (19 kilograms) in the water. This value of buoyancy is required by safety standards to support a person in the water, although a lower buoyancy value could be used, especially with lighter people, to support them in the water with their head above the surface. The amount of air contained by the liner should give the wearer sufficient buoyancy in the water and enable the air, under normal working conditions, mainly to occupy the rear compartment 1 thereby giving the wearer freedom of movement.

FIG. 4 schematically illustrates the wearer fully submerged in water and floating with his head above the surface when the air has moved into the upper sections of compartments 1, 2 and 5. When the wearer is fully submerged, his centre of gravity 15 and the air trapped in these compartments, causes a couple to act on the wearers body bringing it into an upright position. This couple is assisted by a downward movement of the wearers legs and the movement of air into the upper sections of compartments 1, 2 3 and 5. The air trapped in these sections causes compartments 3 to stand out from the wearers chest and compartments 5 to expand upwardly thus lifting the wearers head clear of the water. The neck ring 9 is lifted upwardly by the expansion of compartments 5 and its buoyancy assists in keeping the wearers head clear of the water. Thus, the wearers head is always maintained out of the water whether or not he is injured or unconscious.

As shown in FIGS. 2 and 3, the liner and the neck ring 9 are attached to a loose fitting jacket 11 which includes a hood portion 12. The hood is provided with a cut out portion or visor 13 for visibility. Trousers 14 may also be provided to complete a suit of working clothes. The jacket 11, hood 12 and trousers 14 may be separately provided or joined together to form a one piece overall. The material of the suit is preferably made of flame-proof, anti-static, waterproof material and part of it (for example, the hood 12) may also include some radar reflecting material.

FIGS. 5 and 6 are plan and elevational views of a liner according to a further embodiment, which liner is of a more simple construction to facilitate manufacture. The liner is of double-walled construction and comprises a rear air compartment 16 in a back portion, two front air compartments 17 in a front or chest portion, and two shoulder compartments 18 in a collar portion. Lapel-shaped compartments, such as those designated 3 in FIG. 1, have been omitted. Moreover, the restrictors 7, 8 of the liner in FIG. 1 have been replaced by tubular restrictors 19, which are open at both ends, to allow air to pass from the rear compartment 16 to the front compartment 17 and vice versa.

The front compartments 17 are secured along an inner lateral edge by a fastener such as a zip 20, a cut out portion 22 accommodating the wearers neck. Belt or tie loops 21 are provided along the lower edges of the rear compartments 16 and the front compartments 17.

The liner may be worn on its own (tropical use) or it may form part of, or be attached to a working suit of clothes as previously described with reference to FIGS. 1–3. The amount of air sealed into the liner should provide a bouyancy of at 42 lbs. (19 kilograms) in the water, as required by the usual safety standards. However, as previously explained, the amount of air contained in the liner should give the wearer sufficient bouyancy in the water and mainly occupy the rear compartment 16 under normal working conditions.

As best seen in FIG. 6, the air in the front compartments 17 can only communicate with the shoulder compartments 18 via the restrictor tubes 19 and the rear compartment 16. Under normal working conditions, air may be exchanged between the various compartments due to the movement or position of the wearer. However, as most of the air is contained in the rear compartment 16, the wearers movements are substantially unimpeded.

If the wearer falls into the water, the liner assists in righting the wearer in a substantially similar manner to that described with reference to FIG. 4 (although no lapel-shaped compartments are provided). The wearer will therefore rise to the surface and the air trapped in the liner will be forced, by the water pressure, into the upper sections of the rear compartment 16 and the front compartments 17 and into the shoulder compartments 18. The shoulder compartments form overlying flaps on the front compartments 17 and, when they are inflated, they assist in raising the wearers head clear of the water. Preferably, a neck ring, similar to that designated 9 in FIG. 1 is also provided, so that the inflated shoulder compartments 18 raise the ring against the wearers chin and the back of his head. The water pressure acting on the lower sections of the rear compartment 16 and the front compartments 17 effectively close off the restrictor tubes 19 thereby preventing a flow of air from the front compartments to the rear compartment and hence the shoulder compartments.

It will be appreciated from FIGS. 5 and 6 that the modified liner is of a more simple construction which facilitates manufacture.

Some of the advantages of the preferred embodiments of the invention are as follows:

1. When the wearer wears his working clothes he automatically wears his lifesaving garment.
2. The user can always check that the lifesaving garment is operational by compressing the air, with his arms, to cause the air to travel into the upper sections of the air compartments.
3. There is no possibility of a faulty valve, since the air is sealed into the liner.
4. No action need be taken by the wearer if he falls intp the water accidentally.
5. The suit of working clothes gives full freedom of movement, under working conditions, and is of light construction.
6. The liner can be such that it loses no more than a proportion of its capacity if one of the air compartments is punctured.
7. If the wearer falls into the water, he will always rise to the surface with his head uppermost and his head will be maintained above the surface regardless of the way he falls into the water, or of his condition, for example, if he is injured or unconscious.

What I claim is:

1. A life saving garment comprising a double skinned, totally sealed flexible liner and a buoyant neck ring, said liner enclosing a predetermined quantity of air and having at least a back portion, a front portion and a collar portion, the quantity of air in the liner mainly occupying the back portion during normal working conditions to enable freedom of movement, said liner and said quantity of air being such that the air is forced into the upper part of said back and front portions and into said collar portion when the wearer is substantially submerged in the water, said collar portion, when inflated, raising said neck ring for maintaining the wearer's head above the water.

2. A garment according to claim 1 wherein said collar portion comprises respective expansible shoulder compartments.

3. A garment according to claim 1 wherein said front portion comprises right and left lapel-shaped compartments.

4. A garment according to claim 1 wherein said collar portion comprises respective expansible shoulder compartments and said front portion comprises right and left lapel-shaped compartments, said shoulder compartments communicating with the respective lapel-shaped compartments by means of restrictors.

5. A garment according to claim 1 wherein said collar portion comprises respective shoulder compartments in the form of respective flaps which overlie the front portion.

6. A garment according to claim 1 wherein the back portion defines a rear air compartment and the front portion defines respective right and left front compartments.

7. A garment according to claim 6 wherein the rear compartment communicates with the front compartments by means of respective tubular restrictors.

8. A life saving garment comprising a double skinned, totally sealed, flexible liner and a buoyant neck ring, said liner enclosing a predetermined quantity of air and having a back portion, a front portion and a collar portion which define respective compartments to receive air trapped in the liner, the quantity of air in the liner mainly occupying the back portion during normal working conditions to enable freedom of movement, said collar portion comprising respective expansible shoulder compartments, said front portion comprising right and left lapel-shaped compartments, said shoulder compartments communicating with the respective lapel-shaped compartments by means of restrictors, and the back and front air compartments of said back and front portions respectively also communicating by means of respective restrictors whereby said liner and said quantity of air are such that air is forced into the upper part of said back and front portions and into said collar portion when the wearer is substantially submerged in water, said collar portion, when inflated, raising said neck ring for maintaining the wearer's head above water, and said restrictors preventing the flow of air, due to water pressure, between said respective air compartments.

9. A life saving garment comprising a double skinned, totally sealed, flexible liner and a buoyant neck ring, said liner enclosing a predetermined quantity of air and having a back portion, a front portion and a collar portion, said collar portion comprising respective shoulder compartments in the form of respective flaps which overlie the front portion, said back portion defining a rear air compartment and said front portion defining respective right and left front compartments, said rear compartment communicating with said front compartments by means of respective tubular restrictors, the quantity of air in the liner mainly occupying said back portion during normal working conditions to enable freedom of movement, said liner and said quantity of air being such that the air is forced into the upper part of said back and front portions and into said collar portion when the wearer is substantially submerged in the water, said collar portion, when inflated, raising said neck ring for maintaining the wearer's head above the water, and said restrictors being closed by water pressure to prevent the flow of air from said front to said rear compartments.

* * * * *